US007935041B2

(12) United States Patent
Graham et al.

(10) Patent No.: US 7,935,041 B2
(45) Date of Patent: May 3, 2011

(54) CONTAINER WITH INNER REINFORCEMENT AND METHOD AND SYSTEM OF MANUFACTURING

(75) Inventors: Thomas D. Graham, Winter Garden, FL (US); Amer Aganovic, Orlando, FL (US); Claudio D'Alesio, Windemere, FL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 143 days.

(21) Appl. No.: 12/197,937

(22) Filed: Aug. 25, 2008

(65) Prior Publication Data

US 2010/0044423 A1 Feb. 25, 2010

(51) Int. Cl.
*B31B 7/00* (2006.01)

(52) U.S. Cl. ..... 493/98; 493/51; 493/68

(58) Field of Classification Search ..... 493/98, 493/51, 68, 69, 79, 93, 94, 105
See application file for complete search history.

(56) References Cited

U.S. PATENT DOCUMENTS

| | | | | |
|---|---|---|---|---|
| 1,800,816 | A | | 4/1931 | Cooley |
| 2,967,655 | A | | 1/1961 | Seger, Jr |
| 3,744,702 | A | | 7/1973 | Ellison |
| 3,829,000 | A | | 8/1974 | Ellison |
| 3,986,319 | A | | 10/1976 | Puskarz et al. |
| 4,133,474 | A | | 1/1979 | Hall |
| 4,308,023 | A | | 12/1981 | Bidegain |
| 4,349,345 | A | | 9/1982 | Bodendoerfer |
| 4,608,038 | A | | 8/1986 | Virta et al. |
| 4,706,809 | A | | 11/1987 | Halsell |
| 4,843,798 | A | | 7/1989 | Focke et al. |
| 4,932,930 | A | | 6/1990 | Coalier et al. |
| 5,147,271 | A | | 9/1992 | Bacques et al. |
| 5,219,089 | A | | 6/1993 | Kiolbasa et al. |
| 5,437,388 | A | | 8/1995 | Bartelt et al. |
| 5,656,006 | A | | 8/1997 | East et al. |
| 5,775,576 | A | | 7/1998 | Stone |
| 6,012,629 | A | * | 1/2000 | Newcomer ..... 229/109 |
| 6,015,084 | A | | 1/2000 | Mathieu et al. |
| 6,074,331 | A | * | 6/2000 | Ruggiere et al. ..... 493/89 |
| 6,106,450 | A | | 8/2000 | Brittain |
| 6,328,202 | B1 | | 12/2001 | Giblin |

(Continued)

FOREIGN PATENT DOCUMENTS

EP 0876281 B1 11/1998

(Continued)

*Primary Examiner* — Sameh H. Tawfik
(74) *Attorney, Agent, or Firm* — Armstrong Teasdale LLP

(57) ABSTRACT

A two-piece reinforced container is provided. The container includes an outer structure and an inner structure. The outer structure includes front and rear panels that are coupled to each of a first side panel and a second side panel via at least one corner panel. The corner panels extend from the front panel, the rear panel, the first side panel, and the second side panel at a substantially oblique angle. The inner structure includes front and rear panels that are coupled to each of a first side panel and a second side panel via at least one corner panel. The corner panels extend from the front panel, the rear panel, the first side panel, and the second side panel at a substantially oblique angle. The inner structure is positioned within the outer structure such that each of the first side panel, second side panel, front panel, and rear panel of the outer structure is positioned in an overlapping relationship with the corresponding first side panel, second side panel, front panel, and rear panel of the inner structure.

17 Claims, 9 Drawing Sheets

U.S. PATENT DOCUMENTS

| | | | | |
|---|---|---|---|---|
| 6,358,191 | B1 | 3/2002 | Greever | |
| 6,371,363 | B1 * | 4/2002 | Franklin et al. | 229/109 |
| 7,350,670 | B2 | 4/2008 | Steeves et al. | |
| 2007/0142193 | A1 | 6/2007 | Strong et al. | |
| 2007/0228119 | A1 | 10/2007 | Barner | |
| 2008/0078819 | A1 | 4/2008 | Strong et al. | |
| 2008/0099541 | A1 | 5/2008 | Smith et al. | |

FOREIGN PATENT DOCUMENTS

| | | | |
|---|---|---|---|
| WO | 9727114 | A1 | 7/1997 |

* cited by examiner

CONTAINER WITH INNER REINFORCEMENT AND METHOD AND SYSTEM OF MANUFACTURING

BACKGROUND OF THE INVENTION

The present invention relates to a storage container and, more particularly, to a container having an inner reinforcing structure and method and system of assembling the same.

The merchandising industry is a very diverse industry that provides a variety of products to consumers throughout the world. For example, the merchandising industry includes stores that offer products such as food, electronics, and other consumer products. These types of stores oftentimes use a variety of containers to ship and store the products to be sold to the consumers.

Merchandising stores and shipping companies also attempt to efficiently use space within the store and/or the shipping vehicle. Accordingly, at least some known containers attempt to economize space within the store and/or the shipping vehicle by being stackable. However, at least some known containers lack the requisite strength for stacking. Accordingly, these containers do not eliminate or reduce space while in storage and/or while being shipped, and therefore, do not economize the space within the store and/or the shipping vehicle.

In addition, merchants are increasingly demanding recyclable containers to eliminate the need to store containers while not in use. At least some known containers that are made at least partially from paperboard require metal and/or plastic pieces for assembly. Accordingly, these containers require additional time for assembly and are not fully recyclable.

BRIEF DESCRIPTION OF THE INVENTION

In one aspect, a two-piece reinforced container is provided. The container includes an outer structure and an inner reinforcing structure. The outer structure includes a first side panel, a second side panel, a front panel, a rear panel, and a plurality of corner panels. The first side panel is coupled to the front panel by a first corner panel, the front panel is coupled to the second side panel by a second corner panel, the second side panel is coupled to the rear panel by a third corner panel, the rear panel is coupled to the first side panel by a fourth corner panel and a fifth corner panel in overlapped relationship. The first, second, third, fourth, and fifth corner panels extend from respective front panels and side panels at a substantially oblique angle. The inner structure includes a first side panel, a second side panel, a front panel, a rear panel, and a plurality of corner panels. The first side panel is coupled to the front panel by a first corner panel, the front panel is coupled to the second side panel by a second corner panel, the second side panel is coupled to the rear panel by a third corner panel, and a forth corner panel extends from the rear panel to the first side panel. The first, second, third, fourth, and fifth corner panels extending from the respective front panels and side panels at a substantially oblique angle. The outer structure is formed around the inner structure so that the inner structure is positioned within the outer structure such that each of the first side panel, second side panel, front panel, and rear panel of the outer structure is positioned in an overlapping relationship with the corresponding first side panel, second side panel, front panel, and rear panel of the inner structure.

In another aspect, a pair of blanks for forming a two-piece reinforced container is provided. The pair of blanks includes a first blank and a second blank. The first blank includes a first side panel coupled to a first corner panel by a first fold line, a front panel coupled to the first corner panel by a second fold line, and to a second corner panel by a third fold line. The first blank also includes a second side panel coupled to the second corner panel by a fourth fold line, and to a third corner panel by a fifth fold line, and a rear panel coupled to the third corner panel by a sixth fold line, and to a fourth corner panel by a seventh fold line. The first blank further includes a fifth corner panel coupled to the first side panel by an eighth fold line, wherein the fourth and the fifth corner panels are in an overlapped configuration when the container is formed. The second blank includes a first side panel coupled to a first corner panel by a first fold line, a front panel coupled to the first corner panel by a second fold line, and to a second corner panel by a third fold line. The second blank also includes a second side panel coupled to the second corner panel by a fourth fold line, and to a third corner panel by a fifth fold line, and a rear panel coupled to the third corner panel by a sixth fold line, and to a fourth corner panel by a seventh fold line. Wherein the second blank is folded to form an inner structure and the first blank is folded around the inner structure to form the reinforced container so that the inner structure formed by the second blank is configured to be positioned within a structure formed by the first blank with each of the first side panel, second side panel, front panel, and rear panel of the first blank positioned in an overlapping relationship with a corresponding first side panel, second side panel, front panel, and rear panel of the second blank to form a container.

In a further aspect, a method of forming a two-piece reinforced container from a pair of blanks is provided. The method includes providing a first blank that includes a first side panel coupled to a first corner panel by a first fold line; a front panel coupled to the first corner panel by a second fold line, and to a second corner panel by a third fold line; a second side panel coupled to the second corner panel by a fourth fold line, and to a third corner panel by a fifth fold line; a rear panel coupled to the third corner panel by a sixth fold line, and to a fourth corner panel by a seventh fold line; and a fifth corner panel coupled to the first side panel by an eighth fold line, and providing a second blank having a first side panel coupled to a first corner panel by a first fold line; a front panel coupled to the first corner panel by a second fold line, and to a second corner panel by a third fold line; a second side panel coupled to the second corner panel by a fourth fold line, and to a third corner panel by a fifth fold line; a rear panel coupled to the third corner panel by a sixth fold line, and to a fourth corner panel by a seventh fold line. The method also includes folding the second blank such that the front and rear panels extend between the first side panel and the second side panel and each corner panel extends from at least one of the front panel, the rear panel, the first side panel, and the second side panel at a substantially oblique angle; and then folding the first blank around the folded second blank such the front and rear panels extend between the first side panel and the second side panel and each corner panel extends from at least one of the front panel, the rear panel, the first side panel, and the second side panel at a substantially oblique angle. Wherein folding the first blank further includes folding the first blank over the second blank such that each of the first side panel, second side panel, front panel, and rear panel of the first blank is positioned in an overlapping relationship with the corresponding first side panel, second side panel, front panel, and rear panel of the second blank.

In yet another aspect, a machine for forming a two-piece reinforced container from a pair of blanks is provided. A first blank includes a first side panel coupled to a first corner panel by a first fold line; a front panel coupled to the first corner panel by a second fold line, and to a second corner panel by a third fold line; a second side panel coupled to the second corner panel by a fourth fold line, and to a third corner panel by a fifth fold line; a rear panel coupled to the third corner panel by a sixth fold line, and to a fourth corner panel by a seventh fold line; and a fifth corner panel coupled to the first side panel by an eighth fold line. A second blank includes a first side panel coupled to a first corner panel by a first fold line; a front panel coupled to the first corner panel by a second fold line, and to a second corner panel by a third fold line; a second side panel coupled to the second corner panel by a fourth fold line, and to a third corner panel by a fifth fold line; a rear panel coupled to the third corner panel by a sixth fold line, and to a fourth corner panel by a seventh fold line. The machine includes a first hopper for retaining a plurality of first blanks, a second hopper for retaining a plurality of second blanks, an indexer mechanism for transferring a first blank and a second blank, and a forming mandrel for forming the container. The indexer mechanism is configured to transfer the first blank and the second blank to the forming mandrel The machine also includes a dual folding arm for folding the first blank and then the second blank around the forming mandrel, where the second blank is first folded such that the front and rear panels extend between the first side panel and the second side panel and the plurality of corner panels extend from at least one of the front panel, the rear panel, the first side panel, and the second side panel at a substantially oblique angle. The first blank is then folded over the folded second blank such that the front and rear panels extend between the first side panel and the second side panel and the plurality of corner panels extend from at least one of the front panel, the rear panel, the first side panel, and the second side panel at a substantially oblique angle. The first blank is folded over the second blank such that each of the first side panel, second side panel, front panel, and rear panel of the first blank are positioned in an overlapping relationship with the corresponding first side panel, second side panel, front panel, and rear panel of the second blank.

DETAILED DESCRIPTION OF THE INVENTION

Figure 1:
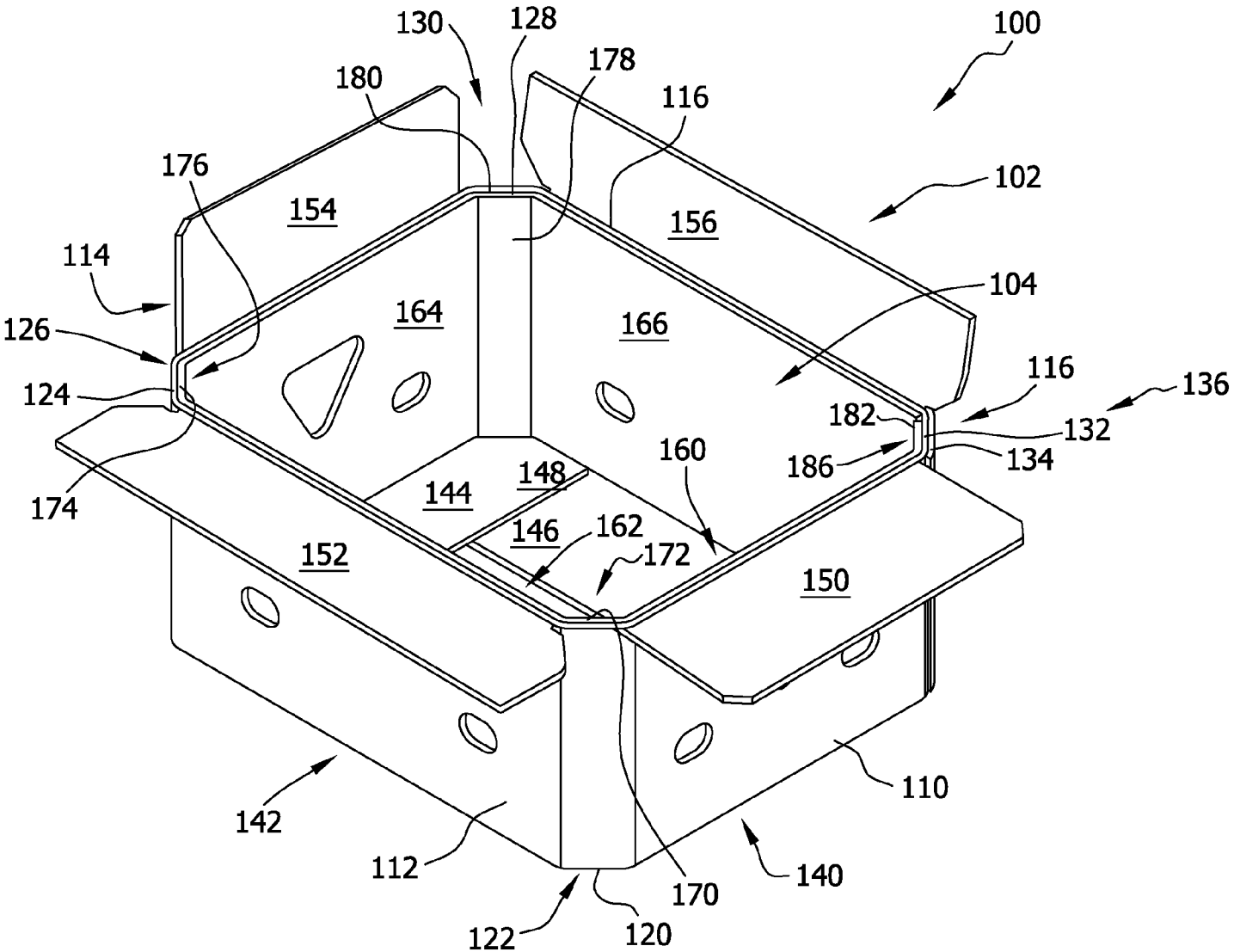
FIG. 1 is a perspective schematic illustration of an exemplary reinforced container.

FIG. 1 is a perspective view of an exemplary reinforced container 100. In the exemplary embodiment, container 100 is a two-piece reinforced container. Specifically, container 100 includes an outer container or structure 102 and an inner band or structure 104 that is positioned within and configured to support outer container 102. Inner band 104 may also be referred to as a reinforcing band. In the exemplary embodiment, outer container 102 includes a first side panel 110, a front panel 112, a second side panel 114, and a rear panel 116. Front panel 112 and rear panel 116 extend between first side panel 110 and second side panel 114. Further, first side panel 110 and second side panel 114 extend between front panel 112 and rear panel 116. First side panel 110 and front panel 112 are coupled via a first corner panel 120 such that first side panel 110 and front panel 112 are substantially perpendicular. Specifically, in the exemplary embodiment, first corner panel 120 extends at a substantially oblique angle between first side panel 110 and front panel 112 to form a first corner 122 of outer container 102. Front panel 112 and second side panel 114 are coupled via a second corner panel 124 such that front panel 112 and second side panel 114 are substantially perpendicular. Specifically, in the exemplary embodiment, second corner panel 124 extends at a substantially oblique angle between front panel 112 and second side panel 114 to form a second corner 126 of outer container 102. Second side panel 114 and rear panel 116 are coupled via a third corner panel 128 such that second side panel 114 and rear panel 116 are substantially perpendicular. Specifically, in the exemplary embodiment, third corner panel 128 extends at a substantially oblique angle between second side panel 114 and rear panel 116 to form a third corner 130 of outer container 102. Rear panel 116 is coupled to first side panel 110 via a pair of overlapping corner panels. Specifically, a fourth corner panel 132 extends from rear panel 116, and a fifth corner panel 134 extends from first side panel 110. Fourth corner panel 132 and fifth corner panel 134 are coupled in an overlapping configuration such that rear panel 116 and first side panel 110 are substantially perpendicular. Specifically, in the exemplary embodiment, fourth corner panel 132 and fifth corner panel 134 are coupled in an overlapping configuration such that fourth corner panel 132 and fifth corner panel 134 extend at a substantially oblique angle between rear panel 116 and first side panel 110 to form a fourth corner 136 of outer container 102. In the exemplary embodiment, each corner panel extends from at least one of first side panel 110, front panel 112, second side panel 114, and rear panel 116 at approximately a 45 degree angle.

Outer container 102 also includes a plurality of bottom panels. Specifically, outer container 102 includes a first bottom panel 140, a second bottom panel 142; a third bottom panel 144, and a fourth bottom panel 146. More specifically, first bottom panel 140 extends from first side panel 110; second bottom panel 142 extends from front panel 112; third bottom panel 144 extends from second side panel 114; and fourth bottom panel 146 extends from rear panel 116. Panels 140, 142, 144, and 146 are positioned in an overlapping configuration to form a bottom 148 of container 100.

Outer container 102 also includes a plurality of top panels. Specifically, outer container 102 includes a first top panel 150, a second top panel 152, a third top panel 154, and a fourth top panel 156. More specifically, first top panel 150 extends from first side panel 110; second top panel 152 extends from front panel 112; third top panel 154 extends from second side panel 114; and fourth top panel 156 extends from rear panel 116. Panels 150, 152, 154, and 156 are configured to overlap to form a top of container 100.

In the exemplary embodiment, inner reinforcing band 104 includes a first side panel 160, a front panel 162, a second side panel 164, and a rear panel 166. First side panel 160 and front panel 162 are coupled via a first corner panel 170 such that first side panel 160 and front panel 162 are substantially perpendicular. Specifically, in the exemplary embodiment, first corner panel 170 extends at a substantially oblique angle between first side panel 160 and front panel 162 to form a first corner 172 of inner band 104. Front panel 162 and second side panel 164 are coupled via a second corner panel 174 such that front panel 162 and second side panel 164 are substantially perpendicular. Specifically, in the exemplary embodiment, second corner panel 174 extends at a substantially oblique angle between front panel 162 and second side panel 164 to form a second corner 176 of inner band 104. Second side panel 164 and rear panel 166 are coupled via a third corner panel 178 such that second side panel 164 and rear panel 166 are substantially perpendicular. Specifically, in the exemplary embodiment, third corner panel 178 extends at a substantially oblique angle between second side panel 164 and rear panel 166 to form a third corner 180 of inner band 104. Rear panel 166 is coupled to first side panel 160 via a fourth corner panel 182. Specifically, in the exemplary embodiment, fourth corner panel 182 extends at a substantially oblique angle between rear panel 166 and first side panel 160 to form a fourth corner 186 of inner band 104. In the exemplary embodiment, each corner panel extends from at least one of first side panel 160, front panel 162, second side panel 164, and rear panel 166 at approximately a 45 degree angle.

In the exemplary embodiment, first side panel 110 of outer container 102 is positioned in an overlapping relationship with first side panel 160 of inner band 104; front panel 112 of outer container 102 is positioned in an overlapping relationship with front panel 162 of inner band 104; second side panel 114 of outer container 102 is positioned in an overlapping relationship with second side panel 164 of inner band 104; and rear panel 116 of outer container 102 is positioned in an overlapping relationship with rear panel 166 of inner band 104. Further, first corner 122 of outer container 102 is positioned in an overlapping relationship with first corner 172 of inner band 104; second corner 126 of outer container 102 is positioned in an overlapping relationship with second corner 176 of inner band 104; third corner 130 of outer container 102 is positioned in an overlapping relationship with third corner 180 of inner band 104; and fourth corner 136 of outer container 102 is positioned in an overlapping relationship with fourth corner 186 of inner band 104.

Figure 2:
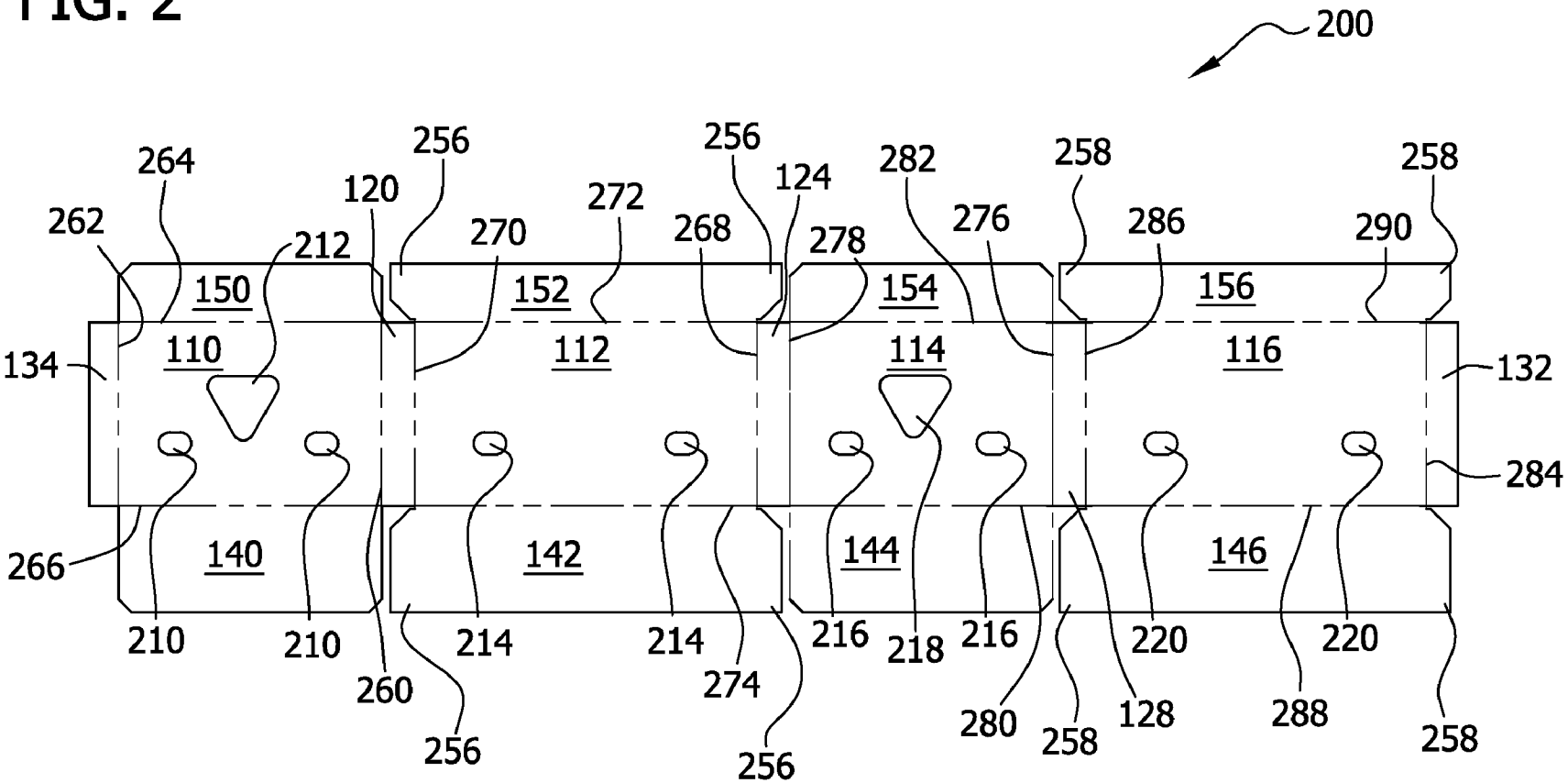
FIG. 2 is a top schematic illustration of a first blank that is used to assemble the container shown in FIG. 1.

FIG. 2 is a top view of a first blank 200 used to form outer container 102 (shown in FIG. 1). In the exemplary embodiment, blank 200 is formed from at least one of paperboard, corrugated paperboard, cardboard and/or any other material suitable for forming outer container 102, as described herein. Blank 200 includes a first side panel 110, front panel 112, a second side panel 114, and rear panel 116. First side panel 110 is substantially rectangular and includes a pair of substantially circular apertures 210 that extend through first side panel 110. First side panel 110 also includes a substantially triangular aperture 212 that extends through first side panel 110 and is positioned between the pair of circular apertures 210.

Front panel 112 is substantially rectangular and includes a pair of substantially circular apertures 214 that extend through front panel 112. Second side panel 114 is substantially rectangular and includes a pair of substantially circular apertures 216 that extend through second side panel 114. Second side panel 114 also includes a substantially triangular aperture 218 that extends through second side panel 114 and is positioned between the pair of circular apertures 216. Rear panel 116 is substantially rectangular and includes a pair of substantially circular apertures 220 that extend through rear panel 116.

In the exemplary embodiment, first side panel 110, front panel 112, second side panel 114, and rear panel 116 are coupled by corner panels. Specifically, as described in more detail below, first side panel 110 and front panel 112 are coupled by first corner panel 120; front panel 112 and second side panel 114 are coupled by second corner panel 124; and second side panel 114 and rear panel 116 are coupled by third corner panel 128. Further, a fourth corner panel 132 extends from rear panel 116, and a fifth corner panel 134 extends from first side panel 110. Each corner panel 120, 124, 128, 132, and 134 is substantially rectangular.

In the exemplary embodiment, blank 200 also includes a plurality of top panels and bottom panels. Specifically, as described below in more detail, first top panel 150 and first bottom panel 140 extend from first side panel 110; second top panel 152 and second bottom panel 142 extend from front panel 112; third top panel 154 and third bottom panel 144 extend from second side panel 114; and fourth top panel 156 and fourth bottom panel 146 extend from rear panel 116. Second top panel 152 and second bottom panel 142 each also include a pair of tabs 256 that extend from an edge of the respective panel. Fourth top panel 156 and fourth bottom panel 146 each also include a pair of tabs 258 that extend from an edge of the respective panel.

In the exemplary embodiment, first side panel 110 is foldably coupled to first corner panel 120, fifth corner panel 134, first top panel 150, and first bottom panel 140. Specifically, first side panel 110 is foldably coupled to first corner panel 120 along a foldline 260; first side panel 110 is foldably coupled to fifth corner panel 134 along a foldline 262; first side panel 110 is foldably coupled to first top panel 150 along a foldline 264; and first side panel 110 is foldably coupled to first bottom panel 140 along a foldline 266.

Further, front panel 112 is foldably coupled to second corner panel 124, first corner panel 120, second top panel 152, and second bottom panel 142. Specifically, front panel 112 is foldably coupled to second corner panel 124 along a foldline 268; front panel 112 is foldably coupled to first corner panel 120 along a foldline 270; front panel 112 is coupled to second top panel 152 along a foldline 272; and front panel 112 is coupled to second bottom panel 142 along a foldline 274.

Moreover, second side panel 114 is foldably coupled to third corner panel 128, second corner panel 124, third top panel 154, and third bottom panel 144. Specifically, second side panel 114 is foldably coupled to third corner panel 128 along a foldline 276; second side panel 114 is foldably coupled to second corner panel 124 along a foldline 278; second side panel 114 is foldably coupled to third top panel 154 along a foldline 280; and second side panel 114 is foldably coupled to third bottom panel 144 along a foldline 282.

In addition, rear panel 116 is foldably coupled to fourth corner panel 132, third corner panel 128, fourth top panel 156, and fourth bottom panel 146. Specifically, rear panel 116 is foldably coupled to fourth corner panel 132 along a foldline 284; rear panel 116 is foldably coupled to third corner panel 128 along a foldline 286; rear panel 116 is foldably coupled to fourth top panel 156 along a foldline 288; and rear panel 116 is foldably coupled to fourth bottom panel 146 along a foldline 290.

Blank 200 is folded to form outer container 102. Specifically, blank 200 is folded along foldlines 260, 262, 268, 270, 276, 278, 284, and 286 and fourth corner panel 132 and fifth corner panel 134 are coupled in an overlapping configuration to form outer container 102. Specifically, front panel 112 and rear panel 116 of blank 200 are positioned substantially parallel to form front panel 112 and rear panel 116 of outer container 102. First side panel 110 and second side panel 114 of blank 200 are positioned substantially parallel to form first side panel 110 and second side panel 114 of outer container 102. Further, first corner panel 120 of blank 200 forms first corner 122 of outer container 102; second corner panel 124 of blank 200 forms second corner 126 of outer container 102; third corner panel 128 of blank 200 forms third corner 130 of outer container 102; and fourth corner panel 132 and fifth corner panel 134 of blank 200 form fourth corner 136 of outer container 102.

Further, when blank 200 is articulated into outer container 102, top panel 150 of blank 200 forms top panel 150 of outer container 102; top panel 152 of blank 200 forms top panel 152 of outer container 102; top panel 154 of blank 200 forms top panel 154 of outer container 102; and top panel 156 of blank 200 forms top panel 156 of outer container 102. Moreover, when blank 200 is articulated into outer container 102, bottom panel 140 of blank 200 forms bottom panel 140 of outer container 102; bottom panel 142 of blank 200 forms bottom panel 142 of outer container 102; bottom panel 144 of blank 200 forms bottom panel 144 of outer container 102; and bottom panel 146 of blank 200 forms bottom panel 146 of outer container 102.

Figure 3:
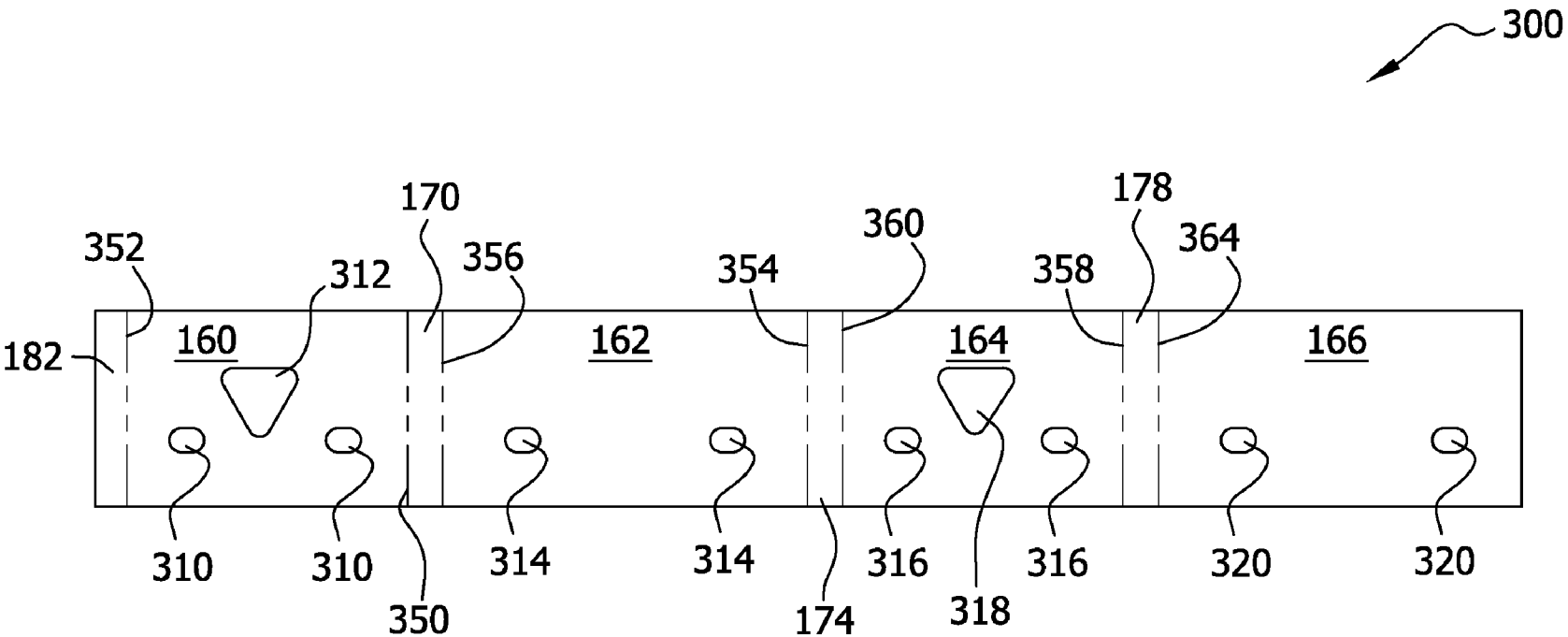
FIG. 3 is a top schematic illustration of a second blank that is used to assemble the container shown in FIG. 1.

FIG. 3 is a top view of a second blank 300 used to assemble a inner band 104 (shown in FIG. 1). In the exemplary embodiment, blank 300 is formed from at least one of paperboard, corrugated paperboard, cardboard and/or any other material suitable for forming a container 100, as described herein. Blank 300 includes a first side panel 160, a front panel 162, a second side panel 164, and a rear panel 166. First side panel 160 is substantially rectangular and has any suitable dimensions that enable blank 300 to form inner band 104, as described herein. First side panel 160 includes a pair of substantially circular apertures 310 that extend through first side panel 160. First side panel 160 also includes a substantially triangular aperture 312 that extends through first side panel 160 and is positioned between the pair of circular apertures 310.

Front panel 162 is substantially rectangular and has any suitable dimensions that enable blank 300 to form inner band 104, as described herein. Front panel 162 includes a pair of substantially circular apertures 314 that extend through front panel 162.

Second side panel 164 is substantially rectangular and has any suitable dimensions that enable blank 300 to form inner band 104, as described herein. Second side panel 164 includes a pair of substantially circular apertures 316 that extend through second side panel 164. Second side panel 164 also includes a substantially triangular aperture 318 that extends through second side panel 164 and is positioned between the pair of circular apertures 316.

Rear panel 166 is substantially rectangular and has any suitable dimensions that enable blank 300 to form inner band 104, as described herein. Rear panel 166 includes a pair of substantially circular apertures 320 that extend through rear panel 166.

In the exemplary embodiment, first side panel 160, front panel 162, second side panel 164, and rear panel 166 are coupled by corner panels. Specifically, as described in more detail below, first side panel 160 and front panel 162 are coupled by a first corner panel 170; front panel 162 and second side panel 164 are coupled by a second corner panel 174; and second side panel 164 and rear panel 166 are coupled by a third corner panel 178. Further, a fourth corner panel 182 extends from first side panel 160. Each corner panel 170, 174, 178, and 182 is substantially rectangular and has suitable dimensions that enable blank 300 to form inner band 104, as described herein.

In the exemplary embodiment, first side panel 160 is coupled to first corner panel 170 along a foldline 350, and first side panel is coupled to fourth corner panel 182 along a foldline 352. Further, front panel 162 is coupled to second corner panel 174 along a foldline 354, and front panel 162 is coupled to first corner panel 170 along a foldline 356. Moreover, second side panel 164 is coupled to third corner panel 178 along a foldline 358, and second side panel 164 is coupled to second corner panel 174 along a foldline 360. In addition, rear panel 166 is coupled to third corner panel 178 along a foldline 364.

Blank 300 is folded to form inner band 104. Specifically, blank 300 is folded along foldlines 350, 352, 354, 356, 358, 360, and 364 to form inner band 104. Specifically, front panel 162 and rear panel 166 of blank 300 are positioned substantially parallel to form front panel 162 and rear panel 166 of inner band 104. First side panel 160 and second side panel 164 of blank 300 are positioned substantially parallel to form first side panel 160 and second side panel 164 of inner band 104. Further, first corner panel 170 of blank 300 forms first corner 172 of inner band 104; second corner panel 174 of blank 300 forms second corner 176 of inner band 104; third corner panel 178 of blank 300 forms third corner 180 of inner band 104; and fourth corner panel 182 forms fourth corner 186 of inner band 104.

Figure 4:
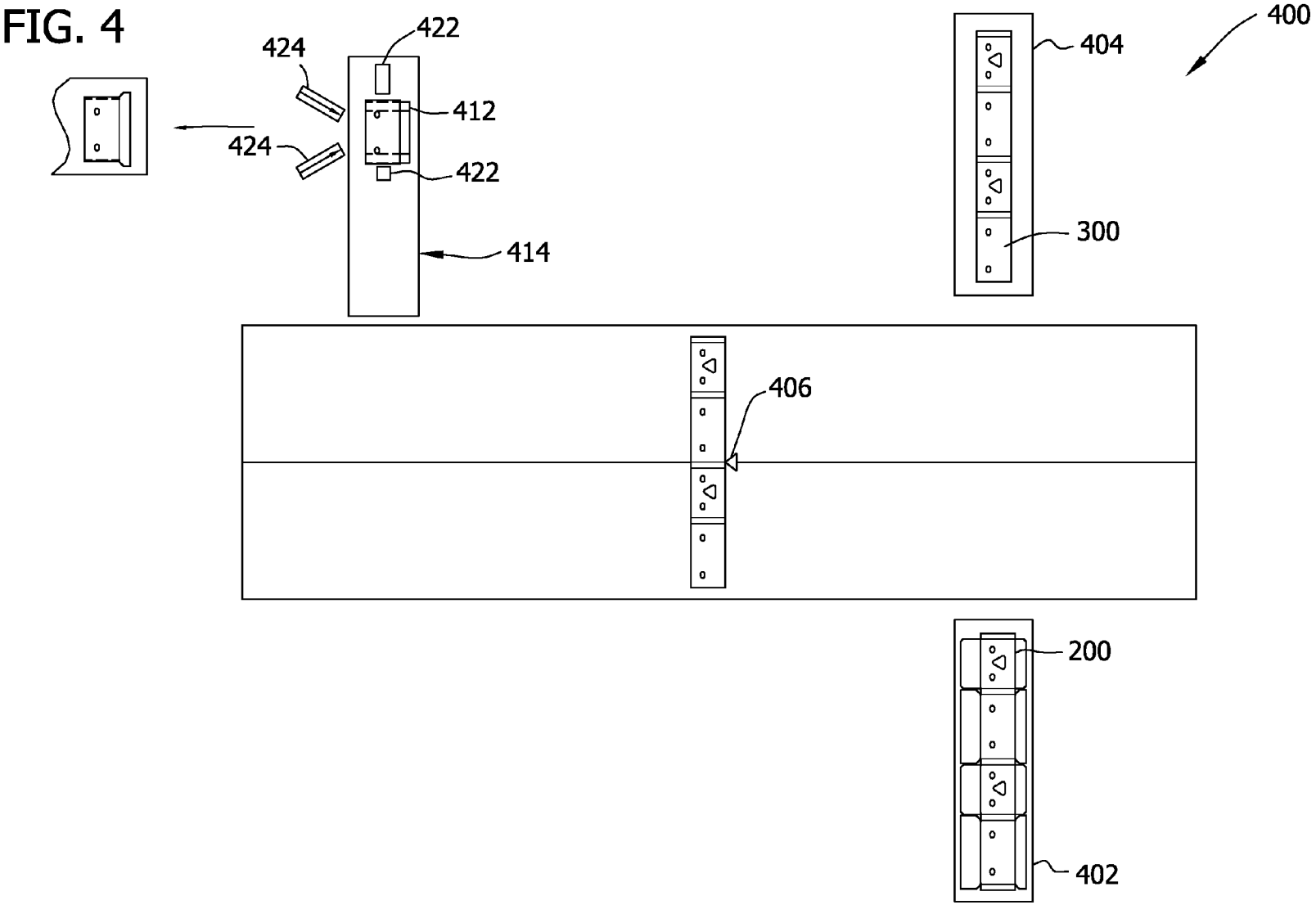
FIG. 4 is a top schematic illustration of an exemplary machine that is used to assemble the container shown in FIG. 1 from the blanks shown in FIGS. 2 and 3.

FIG. 4 is a schematic of an exemplary machine 400 that is used to assemble container 100 from blanks 200 and 300. Machine 400 includes two blank hoppers. First hopper 402 is loaded with blanks 200, and second hopper 404 is loaded with blanks 300. Machine 400 also includes a common indexing station (not shown) and an indexing mechanism 406 configured to transfer blank 200 and blank 300 to a pre-determined position under a forming mandrel 412. The external shape of forming mandrel 412 corresponds to the internal shape of inner band 104.

Machine 400 includes a lifting mechanism 414 that is configured to raise blank 300 and position it against a bottom of forming mandrel 412 and to raise blank 200 and position it against a bottom of previously formed blank 300. Machine 400 includes a folding arm mechanism 422 that is configured to wrap blank 300 around forming mandrel 412 and to wrap blank 200 around previously formed blank 300. Machine 400 also includes bottom flap pusher arms 424 positioned near the bottom end of forming mandrel 412.

Figure 5:
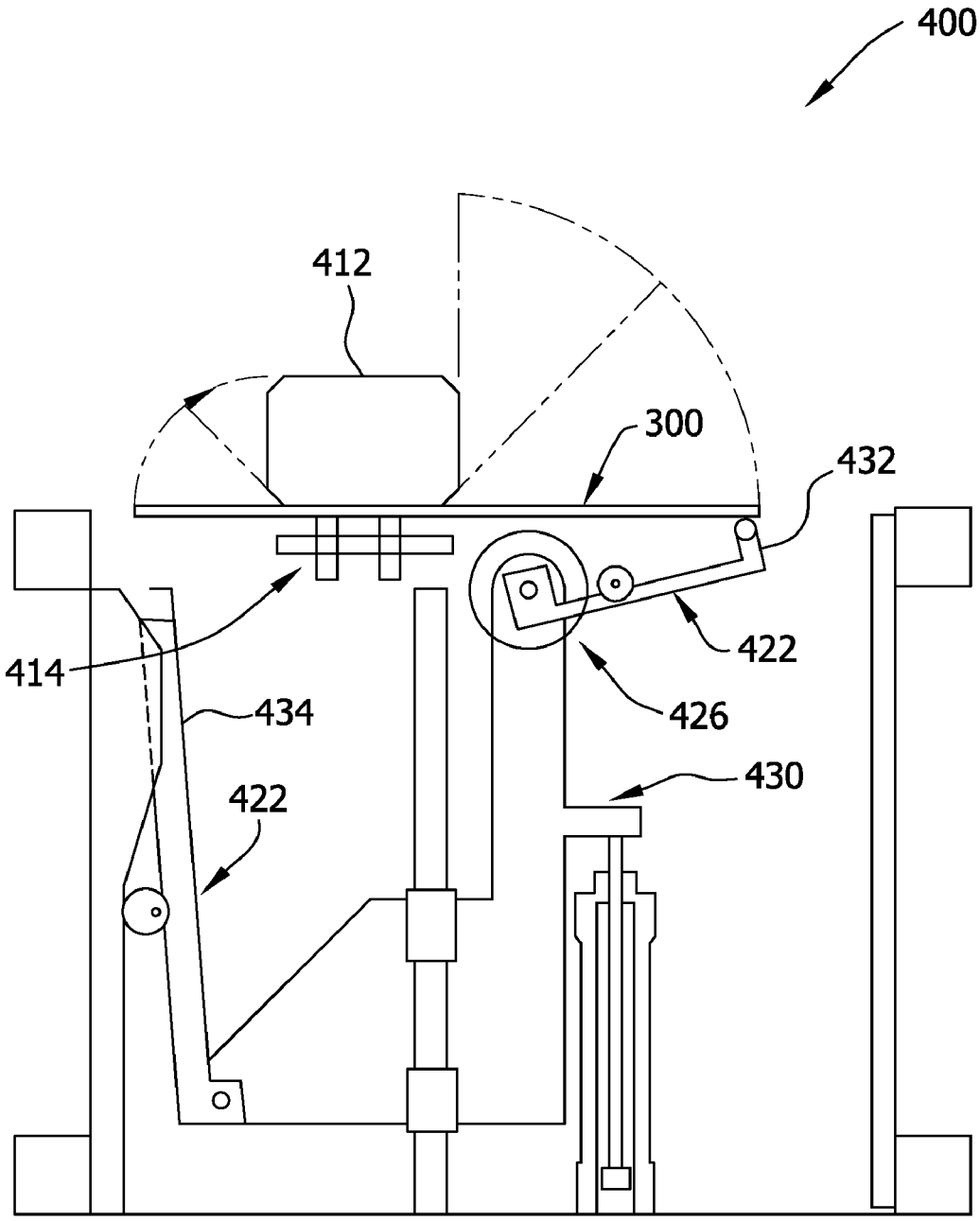
FIG. 5 is a schematic of a portion of the machine shown in FIG. 4.

In one embodiment, a servomechanism 426 is operatively connected to folding arm mechanism 422 for driving and controlling movement of folding arm mechanism 422. Specifically, servomechanism 426 facilitates controlling a speed and a position of folding arm mechanism 422 more accurately and quickly than without the servomechanism. In one embodiment, servomechanism 426 includes an electric motor for driving rotation of folding arm mechanism 422 and at least one gear for controlling an amount of torque output by the motor. In one embodiment, at least one arm 432 and/or 434 of folding arm mechanism 422 rotates between about 150° and 210° with respect to blanks 200 and 300 when folding blanks 200 and 300 around forming mandrel 412. FIG. 5 is a side view of an exemplary machine 400.

During a first cycle, machine 400 selects a blank 300 from hopper 404 and transfers blank 300 to the common indexing station. Blank 300 is then transferred by indexing mechanism 406 to a position under forming mandrel 412 where lifting mechanism 414 raises and positions blank 300 against the bottom of forming mandrel 412. During transfer, an adhesive applicator (not shown) applies hot melt adhesive to the panels of blank 300. In some embodiments, adhesive is applied to at least one panel of blank 300. In other embodiments, adhesive is applied to each panel of blank 300 or none of the panels of blank 300. Blank 300 is formed around forming mandrel 412 by folding arm mechanism 422. More specifically, folding arm mechanism 422 includes a lifting assembly 430, a first rotating arm 432, and a second rotating arm 434. First rotating arm 432 and second rotating arm 434 rotate relative to lifting assembly 430. In the exemplary embodiment, servomechanism 426 is operatively coupled to first rotating arm 432 for controlling movement of first rotating arm 432 relative to lifting assembly 430. Lifting assembly 430 and rotating arms 432 and 434 fold blank 300 against two vertical sides of forming mandrel 412 and over a top of forming mandrel 412. Specifically, lifting assembly 430 starts the rotation of blank 300 around mandrel 412 as it rises upwardly, and then rotating arms 432 and 434 continue the rotation of blank 300 around mandrel 412. A vacuum mechanism (not shown) retains blank 300 against forming mandrel 412 while folding arm mechanism 422 and lifting mechanism 414 retract.

Figure 6:
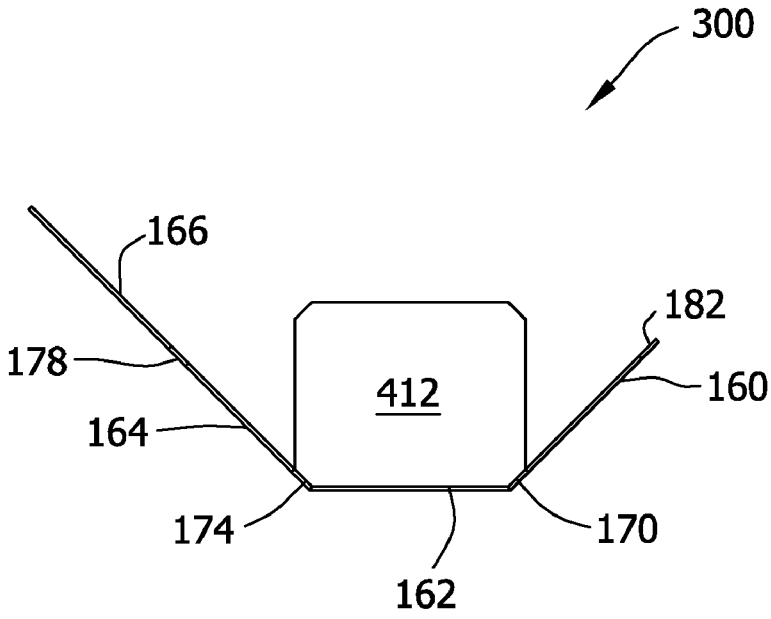
FIG. 6 is a cross section of the mandrel of the machine shown in FIG. 4 illustrating the blank shown in FIG. 3 wrapped partially therearound.
Figure 7:
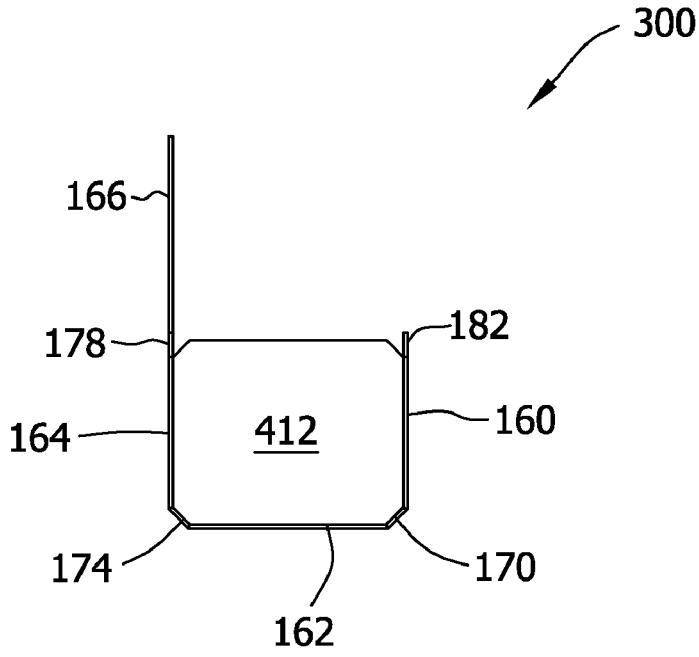
FIG. 7 is a cross section of the mandrel of the machine shown in FIG. 4 illustrating the blank shown in FIG. 3 wrapped partially therearound.
Figure 8:
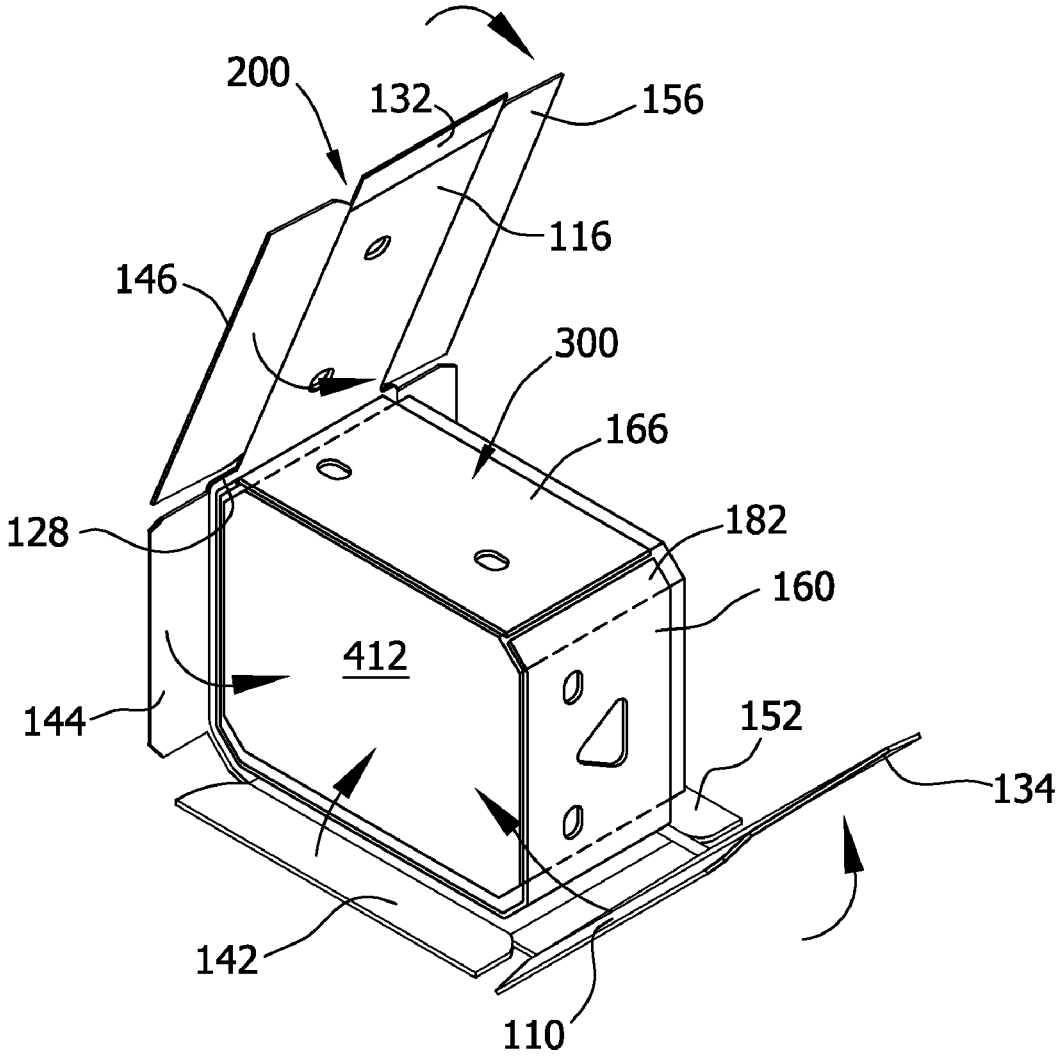
FIG. 8 is a perspective schematic of the mandrel used in the machine shown in FIG. 4 during assembly of the container shown in FIG. 1 from the blanks shown in FIGS. 2 and 3.

FIGS. 6 and 7 illustrate the positions of a blank 300 as it is wrapped around forming mandrel 412, and FIG. 8 illustrates the position of a blank 200 as it is wrapped around previously formed blank 300.

During a second cycle, machine 400 selects a blank 200 from hopper 402. Indexer mechanism 406 transfers blank 200 to a position under forming mandrel 412. During the transfer, an adhesive applicator (not shown) applies hot melt adhesive to at least one of bottom panel 144 and bottom panel 140 and to the external surface of either fourth corner panel 132 or fifth corner panel 134 of blank 200. Lifting mechanism 414 raises blank 200 such that blank 200 is in direct contact with the previously folded blank 300. Rotating arms 432 and 434 are lifted by lifting assembly 430 and wrap blank 200 around previously formed blank 300 such that folded blank 300 is positioned inside folded blank 200.

The bottom panels 144 and 140 of blank 200 are folded in against a bottom of forming mandrel 412 by pusher arms 424. The bottom panels 142 and 146 of blank 200 are then folded over and sealed to bottom panels 144 and 140. The two piece container 100 is ejected from forming mandrel 412 and discharged from machine 400. In the exemplary embodiment, machine 400 provides a single piece of equipment, wherein known systems normally require at least two adjoining conveyors. Machine 400 also provides tight tolerances between blank 200 and blank 300.

Figure 9:
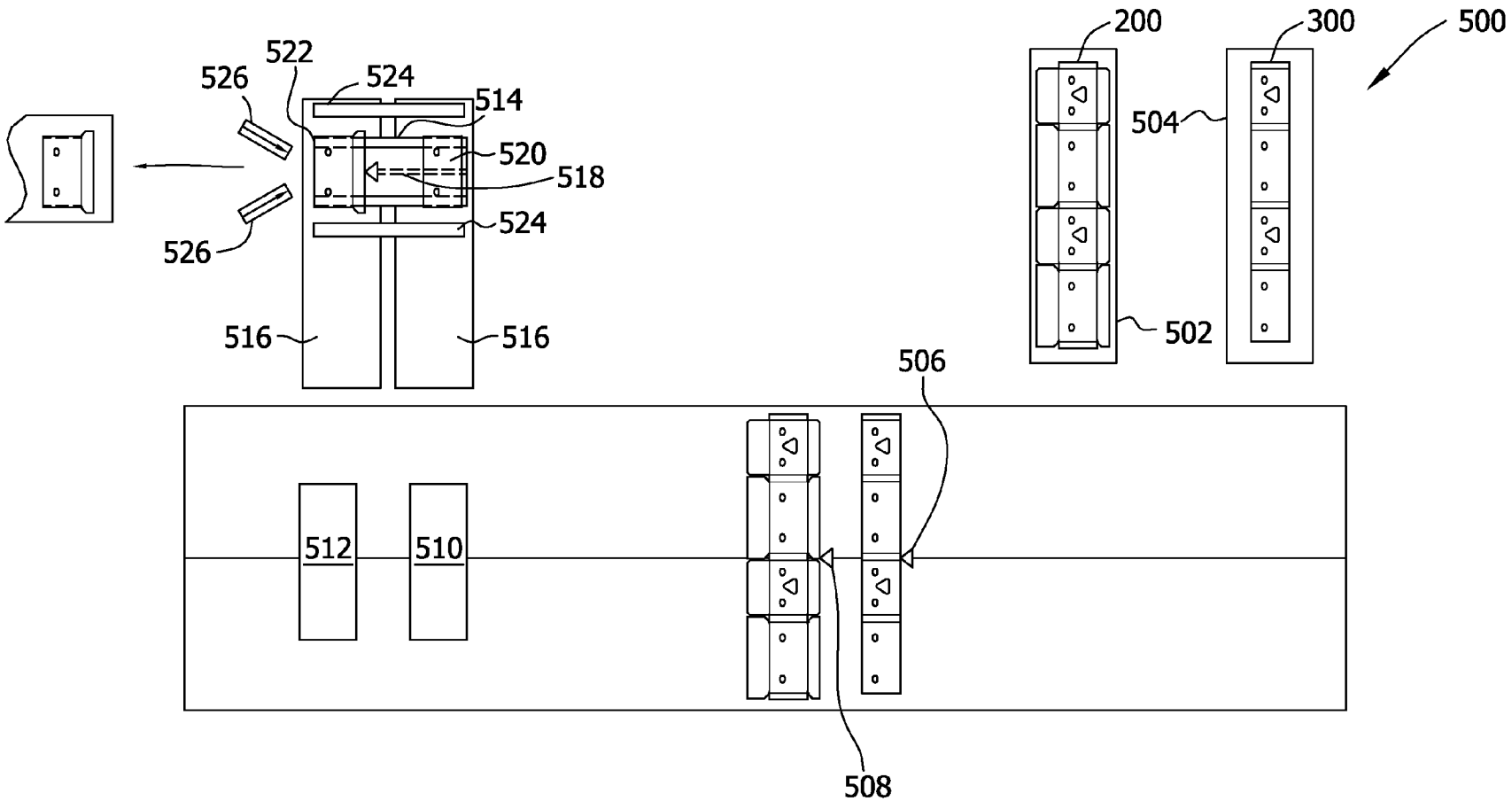
FIG. 9 is a top schematic illustration of an alternative embodiment of a machine that is used to assemble the container shown in FIG. 1 from the blanks shown in FIGS. 2 and 3.

FIG. 9 is a schematic of an alternative embodiment of machine 500 that is used to assemble container 100 from blanks 200 and 300. Machine 500 includes two blank hoppers. First hopper 502 is loaded with blanks 200 and second hopper 504 is loaded with blanks 300. Machine 500 also includes a first indexing station (not shown) that includes a first indexing mechanism 506 configured to transfer blank 300 to a first blank position 510 and a second indexing mechanism 508 configured to transfer blank 200 to a second blank position 512. First and second blank positions 510 and 512 are located directly under an elongated, stationary forming mandrel 514. The external shape of mandrel 514 corresponds to the internal shape of inner band 104.

Machine 500 includes a lifting mechanism 516 that is configured to raise blank 300 and position it against a bottom of forming mandrel 514 and to raise blank 200 and position it against a bottom of previously formed blank 300. A second indexing station 518, also known as a transfer mechanism, is positioned within forming mandrel 514 and is configured to transfer blank 300 from a first mandrel position 520 to a second mandrel position 522. Machine 500 includes a folding arm mechanism 524 that is configured to simultaneously wrap blank 300 around forming mandrel 514 at first mandrel position 520 and wrap blank 200 around previously formed blank 300 at second mandrel position 522. Folding arm mechanism 524 is similar to folding arm mechanism 422 (shown in FIG. 5) and includes a lifting assembly, a first rotating arm, and a second rotating arm, which are substantially similar to lifting assembly 430 (shown in FIG. 5), first rotating arm 432 (shown in FIG. 5), and second rotating arm 434 (shown in FIG. 5), respectively. Machine 500 also includes bottom flap pusher arms 526 positioned near the bottom end of forming mandrel 514.

In one embodiment, a servomechanism is operatively connected to folding arm mechanism 524, such as the first rotating arm, for driving and controlling movement of folding arm mechanism 524. Specifically, the servomechanism facilitates controlling a speed and a position of folding arm mechanism 524 more accurately and quickly than without the servomechanism. In one embodiment, the servomechanism includes an electric motor for driving rotation of folding arm mechanism 524 and at least one gear for controlling an amount of torque output by the motor. In one embodiment, at least one arm of folding arm mechanism 524 rotates between about 150° and 210° with respect to blanks 200 and 300 when folding blanks 200 and 300 around forming mandrel 514.

During a first cycle, machine 500 selects a blank 300 from hopper 504 and transfers blank 300 to the common indexing station. Blank 300 is then transferred by first indexing mechanism 506 to first blank position 510 where lifting mechanism 516 raises and positions blank 300 against the bottom of forming mandrel 514. During transfer, an adhesive applicator (not shown) applies hot melt adhesive to the panels of blank 300. In some embodiments, adhesive is applied to at least one panel of blank 300. In other embodiments, adhesive is applied to each panel of blank 300 or none of the panels of blank 300. Blank 300 is formed around forming mandrel 514 by folding arm mechanism 524. More specifically, folding arm mechanism 524 first folds blank 300 against two vertical sides of forming mandrel 514 and over a top of forming mandrel 514 by lifting the rotating arms using the lifting assembly and by rotating the rotating arms relative to the lifting assembly. A vacuum mechanism (not shown) retains blank 300 against forming mandrel 514 while folding arm mechanism 524 and lifting mechanism 516 retract.

During subsequent cycles, machine 500 selects a blank 200 from hopper 502 and a blank 300 from hopper 504. The first indexing station simultaneously transfers blank 300 to a first blank position 510 and blank 200 to a second blank position 512. Specifically, first indexing mechanism 506 transfers blank 300 to a first blank position 510, and second indexing mechanism 508 transfers blank 200 to second blank position 512. As described above, during the transfer, an adhesive applicator (not shown) may apply hot melt adhesive to at least one of the panels of blank 300. In addition, the adhesive applicator applies hot melt adhesive to at least one of bottom panel 144 and bottom panel 140 and to the external surface of either fourth corner panel 132 and fifth corner panel 134.

Figure 10:
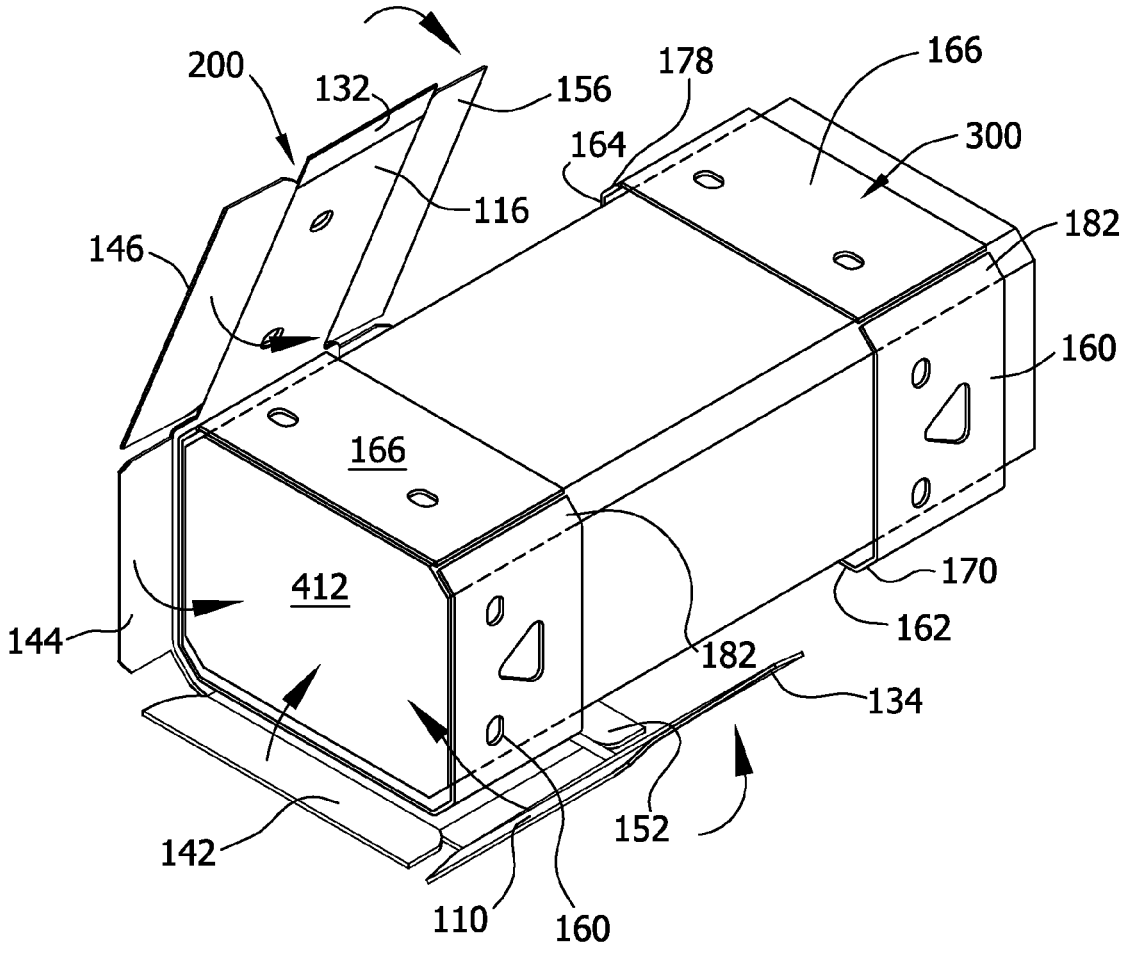
FIG. 10 is a perspective schematic of the mandrel used in the machine shown in FIG. 9 during assembly of the container shown in FIG. 1 from the blanks shown in FIGS. 2 and 3.

Lifting mechanism 516 raises blank 300 as described above and raises blank 200 such that blank 200 is in direct contact with the previously folded blank 300. Folding arm mechanism 524 wraps blank 300 around forming mandrel 514 as is described above, and wraps blank 200 around previously formed blank 300 such that folded blank 300 is positioned inside folded blank 200. Folding arm mechanism 524 could include a single folding mechanism for folding both blanks 300 and 200 at the different folding stations at the same time or could include separate folding mechanisms for folding each blank separately. FIG. 10 illustrates the folded position of blank 200 and blank 300 around forming mandrel 514.

The bottom panels 144 and 140 of blank 200 are folded in against a bottom of forming mandrel 514 by pusher arms 526. The bottom panels 142 and 146 of blank 200 are then folded over and sealed to bottom panels 144 and 140. The two piece container 100 is ejected from forming mandrel 514 and discharged from machine 500. In the exemplary embodiment, machine 500 provides a single piece of equipment, wherein known systems normally require at least two adjoining conveyors. Machine 500 also provides tight tolerances between blank 200 and blank 300.

Exemplary embodiments of the present invention provide a more cost effective package than known designs by reducing an amount of labor required to manufacture container 100, reducing an amount of material required for container 100 and/or reducing the number of equipment pieces required to manufacture container 100.

The above-described method and apparatus provides an inexpensive and secure container for use in the merchandise industry or any other industry. Specifically, the above-described method and apparatus provide a unitary container that is easily assembled by folding portions of a pair of blanks. Further, the container provides added support and strength due to the inner reinforcing band and the adhesive that bonds the outer container and the inner reinforcing band. Moreover, the above-described container provides a reduction in square footage of corrugated paperboard in comparison to known containers and provides a maximization of liner and medium grades of paperboard to facilitate an efficient combination of blanks. Further, the container is fabricated from paperboard, corrugated paperboard, and/or cardboard, and therefore, is also easily recyclable.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of a reinforced container, it is understood that the apparatus and methods are not limited to reinforced containers. Likewise, the container components illustrated are not limited to the specific embodiments described herein, but rather, components of the container can be utilized independently and separately from other components described herein.

While the invention has been described in terms of various specific embodiments, those skilled in the art will recognize that the invention can be practiced with modification within the spirit and scope of the claims.

What is claimed is:

1. A method of forming a two-piece reinforced container from a pair of blanks, said method comprising:

providing a first blank comprising a first side panel coupled to a first corner panel by a first fold line; a front panel coupled to the first corner panel by a second fold line, and to a second corner panel by a third fold line, a second side panel coupled to the second corner panel by a fourth fold line and to a third corner panel by a fifth fold line, a rear panel coupled to the third corner panel by a sixth fold line and to a fourth corner panel by a seventh fold line, and a fifth corner panel coupled to the first side panel by an eighth fold line;

providing a second blank comprising a first side panel coupled to a first corner panel by a first fold line, a front panel coupled to said first corner panel by a second fold line and to a second corner panel by a third fold line, a second side panel coupled to said second corner panel by a fourth fold line and to a third corner panel by a fifth fold line, and a rear panel coupled to said third corner panel by a sixth fold line, said first side panel coupled to a fourth corner panel by a seventh fold line;

folding the second blank such that the front and rear panels extend between the first side panel and the second side panel and each corner panel extends from at least one of the front panel, the rear panel, the first side panel, and the second side panel at a substantially oblique angle; and then folding the first blank around the folded second blank such the front and rear panels extend between the first side panel and the second side panel and each corner panel extends from at least one of the front panel, the rear panel, the first side panel, and the second side panel at a substantially oblique angle, wherein folding the first blank further comprises folding the first blank over the second blank such that each of the first side panel, second side panel, front panel, and rear panel of the first blank is positioned in an overlapping relationship with the corresponding first side panel, second side panel, front panel, and rear panel of the second blank.

2. A method in accordance with claim 1 wherein folding the first blank over the second blank further comprises folding the first blank over the second blank such that each corner panel of the first blank is positioned in an overlapping relationship with the corresponding corner panel of the second blank.

3. A method in accordance with claim 1 wherein folding the first blank further comprises folding the first blank such that the fourth corner panel of the first blank is positioned in an overlapping relationship with the fifth corner panel of the first blank.

4. A method in accordance with claim 1 wherein providing a first blank further comprises providing a first blank including at least one top panel extending from at least one of the first side panel, the second side panel, the front panel, and the rear panel.

5. A method in accordance with claim 4 wherein folding the first blank further comprises overlapping at least two top panels to form a top of the reinforced container.

6. A method in accordance with claim 1 wherein providing a first blank further comprises providing a first blank including at least one bottom panel extending from at least one of the first side panel, the second side panel, the front panel, and the rear panel.

7. A method in accordance with claim 6 wherein folding the first blank further comprises overlapping at least two bottom panels to form a bottom of the reinforced container.

8. A method in accordance with claim 1 further comprising bonding the first blank to the folded second blank.

9. A method in accordance with claim 1 wherein providing a first blank further comprises providing a first blank including an aperture extending through at least one of the first side panel, the second side panel, the front panel, and the rear panel of the first blank.

10. A method in accordance with claim 9 wherein providing a second blank further comprises providing a second blank including an aperture extending through at least one of the first side panel, the second side panel, the front panel, and the rear panel of the second blank.

11. A method in accordance with claim 10 further comprising aligning an aperture formed in the second blank with a corresponding aperture formed in the first blank.

12. A method in accordance with claim 1 wherein providing a first blank and providing a second blank further comprises providing a first blank and a second blank comprising at least one of paperboard, corrugated paperboard, and cardboard.

13. A method in accordance with claim 1 wherein folding the second blank further comprises folding the second blank such that said fourth corner panel abuts said rear panel of said second blank.

14. A method in accordance with claim 1 wherein folding the second blank further comprises folding the second blank around a forming mandrel, and holding the folded second blank against the forming mandrel by applying a vacuum pressure to an internal side of the folded second blank.

15. A method in accordance with claim 14 wherein folding the first blank further comprises folding the first blank around the folded second blank while the folded second blank is held against the forming mandrel.

16. A method in accordance with claim 14 wherein folding the first blank further comprises aligning the first blank with the folding mandrel while the folded second blank is wrapped around the folding mandrel, and folding the first blank around the folded second blank while the folded second blank is wrapped around the forming mandrel.

17. A method in accordance with claim 14 wherein folding the first blank further comprises applying an adhesive to an external side of the folded second blank while the folded second blank is wrapped around the forming mandrel, and attaching the first blank to the folded second blank by folding the first blank around the external side of the folded second blank such that the adhesive fixedly attaches the blanks together.

* * * * *